US008087602B1

(12) United States Patent
Teng

(10) Patent No.: US 8,087,602 B1
(45) Date of Patent: Jan. 3, 2012

(54) MORTAR AND PESTLE

(76) Inventor: Eric Y. Teng, Gold River, CA (US)

( * ) Notice: Subject to any disclaimer, the term of this patent is extended or adjusted under 35 U.S.C. 154(b) by 92 days.

(21) Appl. No.: 12/761,439

(22) Filed: Apr. 16, 2010

Related U.S. Application Data

(63) Continuation-in-part of application No. 12/322,404, filed on Feb. 2, 2009, now abandoned.

(60) Provisional application No. 61/067,084, filed on Feb. 25, 2008.

(51) Int. Cl.
*B02C 19/08* (2006.01)

(52) U.S. Cl. ..... 241/169.2; 241/168

(58) Field of Classification Search ..... 241/168, 241/169.2; D24/220
See application file for complete search history.

(56) References Cited

U.S. PATENT DOCUMENTS

| | | | |
|---|---|---|---|
| 1,878,263 | A | 9/1932 | Chott |
| 2,892,595 | A | 6/1959 | Tupper |
| 4,341,356 | A | 7/1982 | Hiott et al. |
| 4,348,950 | A | 9/1982 | Harris |
| 4,967,971 | A | 11/1990 | Smith |
| D490,160 | S | 5/2004 | Sorensen |
| D543,634 | S | 5/2007 | Lundstrom |

FOREIGN PATENT DOCUMENTS

| | | |
|---|---|---|
| EP | 0040182 | 11/1981 |

OTHER PUBLICATIONS

Francis, Faye; Office Action; Jun. 11, 2009; Related U.S. Appl. No. 12/322,404.

Francis, Faye; Office Action; Dec. 30, 2009; Related U.S. Appl. No. 12/322,404.

*Primary Examiner* — Faye Francis

(74) *Attorney, Agent, or Firm* — The Richards Law Firm; William B. Richards

(57) ABSTRACT

A mortar and pestle, the pestle having a dome-shaped top formed to be cupped within the palm of the hand, a body, and a bottom portion, the bottom portion formed to include a male apex. The interior of the mortar is formed to include an inverted frustum-shaped wall and an interior bowl extending from the interior inverted frustum-shaped wall. The bowl includes a female apex which cooperates with the male apex and into which the male apex may nest. The pestle has an external surface profile which is substantially similar to, and cooperates with, a mortar internal surface profile. Rotating the top of the pestle in a smooth, continuous motion about a circular locus processes material placed in the mortar as the pestle profile sweeps the mortar profile.

19 Claims, 3 Drawing Sheets

MORTAR AND PESTLE

CROSS-REFERENCES TO RELATED APPLICATIONS

This application is a continuation-in-part of, and claims priority to, currently pending U.S. patent application Ser. No. 12/322,404 filed Feb. 2, 2009 which claims the benefit of U.S. Prov. Pat. App. No. 60/067,084 filed Feb. 25, 2008, now expired, the contents of each of which are included herein as if fully rewritten herein.

BACKGROUND OF THE INVENTION

1. Field of the Invention

This invention relates generally to grinding and crushing and, more specifically, to mortar-and-pestle devices.

2. Description of Related Art

Basic mortar-and-pestle devices have long been used to grind, crush, and mix hard ingredients such as corn, rice, and wheat as well as medications, especially those in pill form. Such devices consist of a bowl-shaped mortar and a rod, or pestle, designed to be gripped by hand by the user. In spite of the long history of mortar-and-pestle devices, there is need for improvement for operational efficiency as well as ease-of-use of hand-operated devices.

BRIEF SUMMARY OF THE INVENTION

To meet these needs, the present invention features first a pestle designed to be easily driven in a circular motion by cupping the palm of the hand around a dome-shaped top. This motion reduces the involvement of the wrist in manipulating the pestle for more comfortable operation. In addition, while the pestle is driven in a circular motion, a male apex at the bottom of the pestle nests with a female apex at the bottom of the mortar to provide a stationary pivot point. Further, the profile of the pestle sweeps along an aligned profile of the interior of the mortar to provide efficient operation of the mortar-and-pestle combination. Flutes or ribs formed into the surfaces of the pestle and the interior of the mortar improve grinding, crushing, and mixing.

In an exemplary embodiment, the present invention features a pestle, formed to cooperate with a mortar, the pestle comprising a dome-shaped top portion formed to be cupped within the palm of the hand, a body portion extending from the top portion, and a bottom portion extending from the body portion and opposing the top portion and formed to include a male apex. A surface of the body portion, a surface of the bottom portion, and a surface of the male apex cooperate to form a pestle external profile. The mortar of the exemplary embodiment features a base and a wall extending from the base, the wall topped with a lip. An interior of the mortar features an interior inverted frustum-shaped wall adjacent to the lip and cooperating with an interior bowl extending from the inverted frustum-shaped wall, the bowl formed to include a female apex. A surface of the interior inverted frustum-shaped wall, a surface of the interior bowl, and a surface of the female apex cooperate to form a mortar interior profile.

In a further exemplary embodiment, when the pestle rests within the mortar with the male apex nesting within the female apex, the pestle external profile aligns with the mortar interior profile.

In a further exemplary embodiment, the body portion is cylindrical.

In a further exemplary embodiment, a locus of an axis of the pestle describes a cone when the pestle is rotated through a circular locus.

In a further exemplary embodiment, the cone forms an angle of between 20 and 60 degrees.

In a further exemplary embodiment, the cone forms an angle of between 35 and 45 degrees.

In a further exemplary embodiment, the cone forms an angle of about 40 degrees.

In a further exemplary embodiment, the body portion is in the shape of an inverted frustum of a cone.

In a further exemplary embodiment, the bottom portion is in the shape of the inverted top of a cone and the bowl is in the shape of an inverted top of a cone.

In a further exemplary embodiment, the bottom portion is dome-shaped and the bowl is dome-shaped.

In a further exemplary embodiment, the dome-shaped top portion forms a portion of an oblate spheroid.

In a further exemplary embodiment, the bottom portion forms a portion of a prolate spheroid and the bowl forms a portion of a prolate spheroid.

In a further exemplary embodiment, the bottom portion forms a portion of a rotated vesica piscis and the bowl forms a portion of a rotated vesica piscis.

In a further exemplary embodiment, the body portion comprises ribs or flutes running at least partially between the top portion and the bottom portion.

In a further exemplary embodiment, the bottom portion comprises ribs or flutes running at least partially between the body portion and the male apex.

In a further exemplary embodiment, the interior wall comprises ribs or flutes running at lest partially between the lip and the bowl.

In a further exemplary embodiment, the bowl comprises ribs or flutes running at least partially between the interior wall and the female apex.

In an exemplary operation, the pestle is placed in the mortar, the male apex nests into the female apex, and the pestle exterior profile meshes with the mortar internal profile. The pestle is rotated by placing the palm of the hand on the pestle top portion and rotating about a circular locus while keeping the male apex nested in the female apex and the pestle exterior profile meshed with the mortar internal profile. While rotating the pestle about a circular locus, the nesting of the male apex within the female apex remains substantially stationary while the alignment of the pestle profile with the alignment of the mortar profile sweeps around in a circular locus. Thus, materials placed in the mortar may be variously ground, crushed, and mixed. The rotational motion and grinding, crushing, and mixing may be aided by riding a portion of the pestle along the lip of the mortar.

In a further exemplary operation, a material to be processed is placed into a mortar, the mortar comprising a female apex, a pestle is laid within the mortar, the pestle comprising a male apex, and a profile of the pestle aligns with a profile of the mortar. The pestle is rotated in a circular locus while the nesting of the male apex within the female apex remains substantially stationary and the alignment of the pestle profile with the mortar profile sweeps around in a circular locus.

In a further exemplary operation, a locus of an axis of the pestle describes a cone as the pestle is rotated in a circular locus.

In a further exemplary operation, the cone forms an angle of between 20 and 60 degrees.

In a further exemplary operation, the cone forms an angle of between 35 and 45 degrees.

In a further exemplary operation, the cone forms an angle of about 40 degrees.

The foregoing and other objects, features, and advantages of the invention will become apparent from the following disclosure in which one or more preferred embodiments of the invention are described in detail and illustrated in the accompanying drawings. It is contemplated that variations in procedures, structural features, and arrangement of parts may appear to a person skilled in the art without departing from the scope of or sacrificing any of the advantages of the invention.

DETAILED DESCRIPTION OF THE INVENTION

Figure 1:
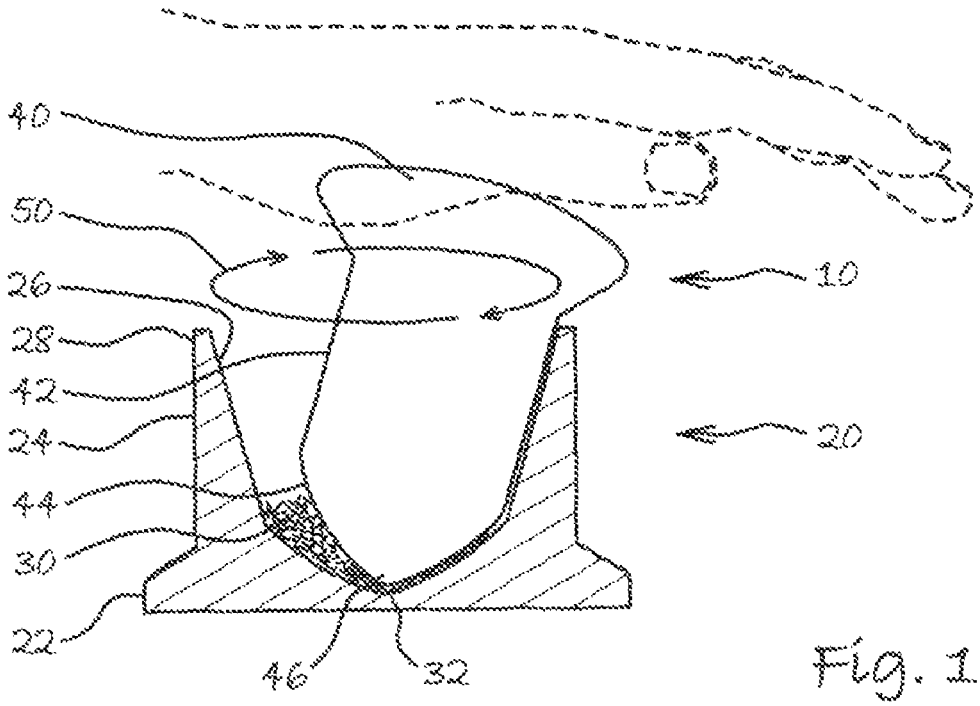
FIG. 1 is a partial cutaway view of an exemplary embodiment of the present invention.

Turning first to FIG. 1, an exemplary embodiment of the invention is shown which includes a pestle 10 and a mortar 20. The pestle 10 comprises a dome-shaped top portion 40 which is formed to fit comfortably in the palm of a hand of a user. The top portion 40 may have a shape similar to that of a mushroom, with a smooth curved surface. Likewise, the top portion 40 may have a shape similar to that of a portion of an oblate spheroid which is formed by rotating an ellipse along its minor axis. Such a broad surface helps make the pestle 10 easier to control and to rotate in a circular locus 50. (See FIGS. 2 and 3.)

Extending from the pestle top portion 40 is a body portion 42. As shown, the body portion 42 is circular, but the body portion 42 may also have other shapes, for example, an inverted frustum of a cone. In an exemplary embodiment, the body portion 42 has a diameter of between about 45 mm and about 55 mm where the body portion 42 extends from the top portion 40. and a diameter of between about 45 mm and about 55 where the body portion 42 meets a bottom portion 44 (described below). Good results have been obtained where the diameter where the body portion 42 extends from the top portion 40 is slightly larger than the diameter where the body portion 42 meets the bottom portion 44. In an exemplary embodiment, the diameter where the body portion 42 extends from the top portion 40 is about 50 mm and the diameter where the body portion 42 meets the bottom portion 44 is about 45 mm.

Figure 2:
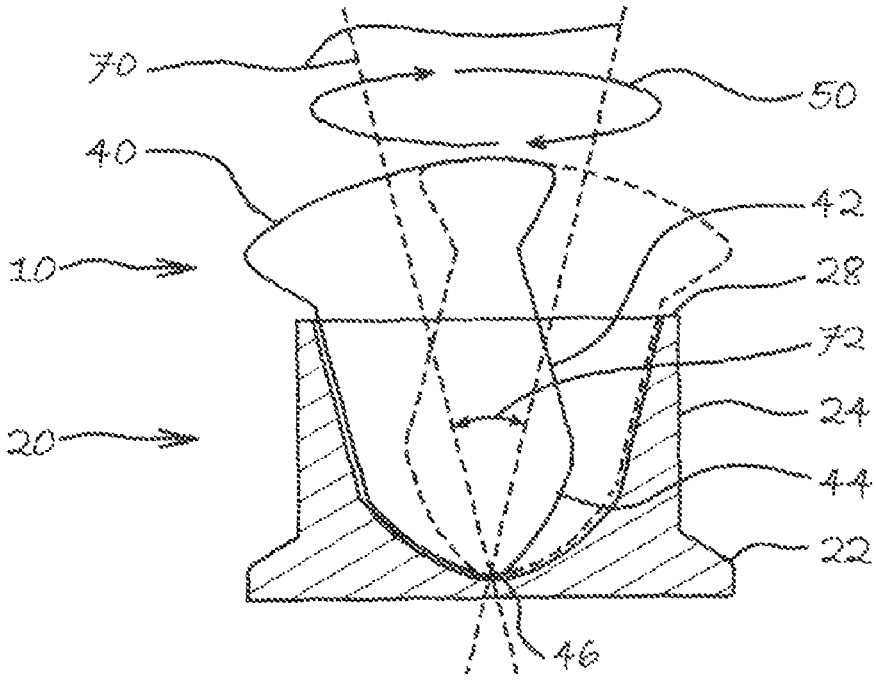
FIG. 2 is a further partial cutaway view of the embodiment of FIG. 1 illustrating the rotational motion of the pestle in the mortar.

Extending from the pestle body portion 42, and opposing the top portion 40, is the bottom portion 44. As shown, the bottom portion 44 is dome-shaped, but the bottom portion 44 may also be shaped like an inverted top of a cone or shaped like a portion of a prolate spheroid which is formed by rotating an ellipse along its major axis or shaped like a portion of a rotated vesica piscis. The bottom portion 44 includes a male apex 46 at the center of the bottom portion 44. As illustrated in FIG. 2, the male apex 46 nests in, and cooperates with, a female apex 32. (Best illustrated in FIGS. 2 and 5.) The male apex 46 need not be sharp or pointed, although it may be. A rounded male apex 46 which matches the female apex 32 is sufficient. Likewise, the female apex 32 need not resemble an inverted cone with a sharp or pointed profile, although it may be. A rounded female apex 32 which matches the male apex 46 is sufficient.

Figure 3:
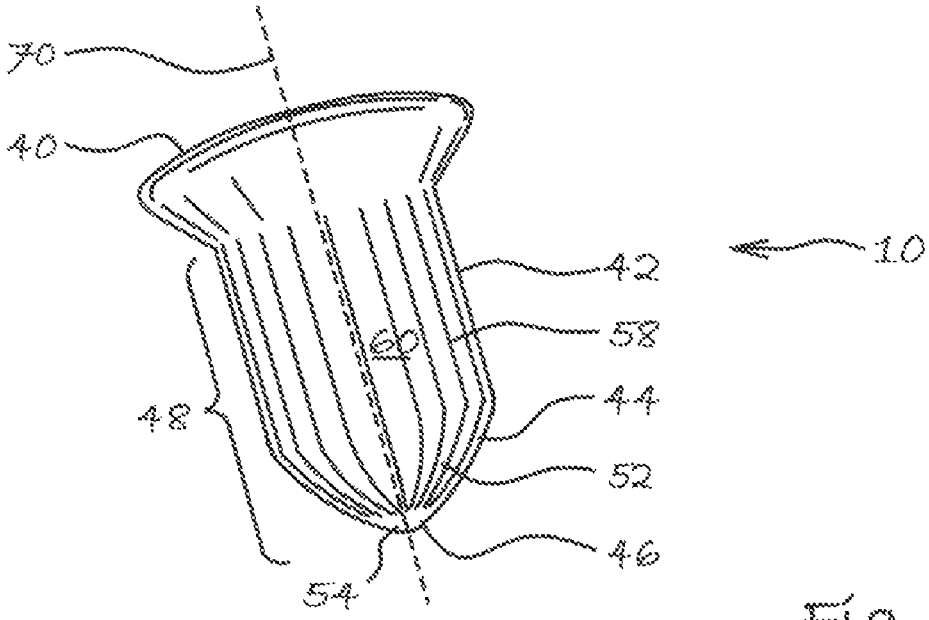
FIG. 3 is a elevation view of the pestle of the embodiment of FIGS. 1 and 2.

Also shown in FIG. 3 are optional flutes or ribs 58 running in at least partially along a body surface 60 and a bottom surface 52.

Also shown in FIG. 3, the pestle 10 provides a pestle profile 48 which comprises the body surface 60, the bottom surface 52, and a male apex surface 54. As discussed further below, the pestle profile 48 aligns with, and cooperates with, a mortar internal profile 36

As shown in FIG. 1, the mortar 20 is preferably circular and comprises a base 22 from which extends a wall 24. The wall 24 is topped with a lip 28. The mortar 20 further includes an interior 16 extending below the lip 28. The interior 16 includes an interior inverted frustum-shaped wall 34 adjacent the lip 28. Extending from the interior inverted frustum-shaped wall 34 is a bowl 14 which is formed to include the female apex 32, which, as discussed above, accepts, and cooperates with, the male apex 46. In an exemplary embodiment, the internal diameter of the frustum-shaped wall 34 at the lip 28 is between about 70 mm and about 75 mm and an internal diameter of between about 45 and about 50 mm where the frustum-shaped wall 34 meets the bowl 14.

Good results have been obtained where the internal diameter of the frustum-shaped wall 34 at the lip 28 is larger than the diameter where the body portion 42 extends from the top portion 44 and where the internal diameter where the frustum-shaped wall 34 meets the bowl 14 is larger than the diameter where the body portion 42 meets the bottom portion 44. In an exemplary embodiment, the diameter of the frustum-shaped wall 34 at the lip 28 is about 75 mm and the diameter where the frustum-shaped wall 34 meets the bowl 14 is about 50 mm.

As shown, the bowl 14 is dome-shaped, but the bowl 14 may also be shaped like an inverted top of a cone or shaped like a portion of a prolate spheroid or shaped like a portion of a rotated vesica piscis. The body 42 is shaped to cooperate with the interior inverted frustum-shaped wall 34 and may be cylindrical or in the shape of an inverted frustum of a cone. The bottom 44 is shaped to cooperate with the bowl 14. A dome-shaped bottom 44 would cooperate with a dome-shaped bowl 14, a bottom 44 shaped like a portion of a prolate spheroid would cooperate with a bowl 14 shaped like a portion of a prolate spheroid, a bottom 44 shaped like an inverted top of a cone would cooperate with a bowl 14 shaped like an inverted top of a cone, and a bottom 44 shaped like a portion of a rotated vesica piscis would cooperate with a bowl 14 shaped like a portion of a rotated vesica piscis.

Figure 4:
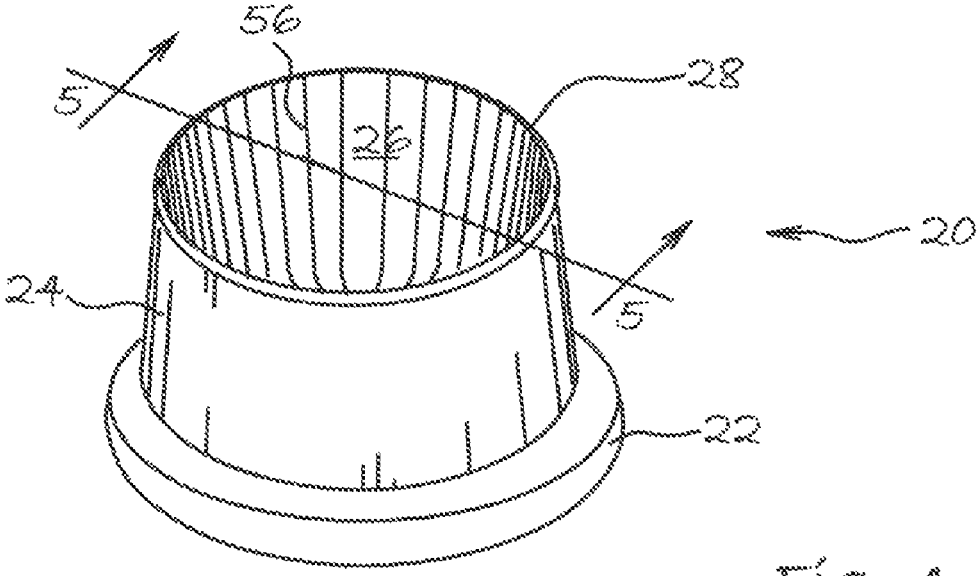
FIG. 4 is a perspective view of the mortar of the embodiment of FIGS. 1 and 2.

As shown in FIG. 4, optional flutes or ribs 56 may run at least partially along the wall interior surface 26 and the bowl interior surface 38. The mortar flutes or ribs 56 cooperate with the pestle flutes or ribs 58 to provide a more efficient and more effective grinding, crushing, or mixing of the material 30.

Figure 5:
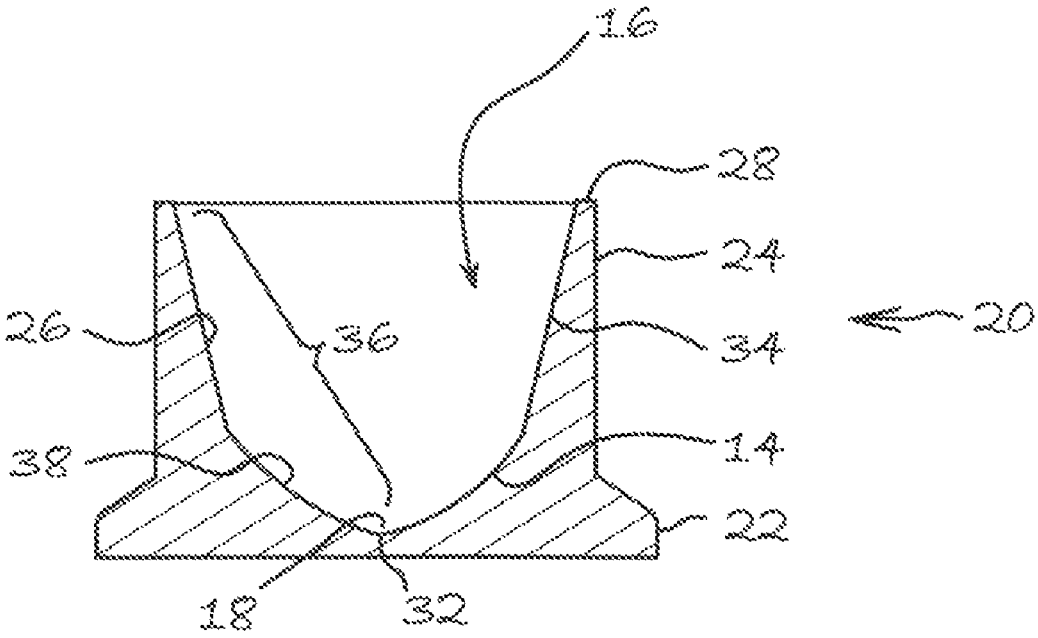
FIG. 5 is a cutaway view of the mortar of FIG. 4 along the line 5-5.

Turning now to FIG. 5, the mortar 20, and particularly the mortar interior 16, provides the mortar internal profile 36 which comprises a wall interior surface 26, a bowl interior surface 38, and a female apex surface 18. The pestle profile 48 aligns with, and cooperates with, the mortar internal profile 36.

In operation, material to be processed 30 is placed into the mortar 20, preferably within the bowl 14, and the pestle 10 is placed within the mortar 20 with the male apex 46 nesting, as is practical, given the material 30, within the female apex 32. The pestle top portion 40 or the pestle body portion, as is practical, given the material 30, may be rested against the lip 28. Such positioning brings the pestle profile 48 and the mortar internal profile 36, which closely correlate, in cooperation to create a line of focused pressure between the pestle 10 and the mortar 20. The palm of the hand is then placed upon the pestle top portion 40 and the pestle 10 rotates in a smooth, continuous motion, about a locus 50 to process the material 30. As an aid to smooth operation, the pestle 10 may ride along the lip 28 as the pestle 10 is rotated through the circular locus 50. While rotating the pestle 10, the user can exert a downward force on the mortar 20 to aid in processing the material and in keeping the male apex 46 nested in the female apex 32. Thus, the pestle 10 pivots about the male apex 46 nested in the female apex 32. The female apex 32 remains stationary while the distinct line of focused pressure formed between the pestle profile 48 and the mortar internal profile 36 sweeps in the circular locus 50. The degree of processing, including the particle size, of the material 30, can be controlled by the amount of downward force and the duration of processing.

Referring again to FIG. 2, while rotating the pestle 10 through the circular locus 50, a pestle axis 70 may sweep around in a cone forming an angle 72 of about 40 degrees. The angle 72 may be between 25 and 55 degrees and between 35 and 45 degrees.

This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. An apparatus, comprising:
- a pestle, the pestle comprising:
  - a dome-shaped top portion, the top portion formed to be cupped within the palm of a hand of a user;
  - a cylindrical body portion extending from the top portion; and
  - a dome-shaped bottom portion extending from the body portion and opposing the top portion, the bottom portion formed to include a male apex, wherein:
    - a surface of the body portion, a surface of the bottom portion, and a surface of the male apex form a pestle external profile;
    - the pestle body surface comprises elements chosen from the group consisting of flutes and ribs; and
    - the pestle bottom surface comprises elements comprises elements chosen from the group consisting of flutes and ribs; and
- a mortar, the mortar comprising:
  - a base;
  - a wall extending from the base, the wall topped with a lip; and
  - an interior, the interior comprising:
    - an interior inverted frustum-shaped wall adjacent to the lip; and
    - an interior bowl extending from the interior inverted frustum-shaped wall, the bowl formed to include a female apex, the female apex formed to cooperate with the male apex; and wherein:
- a surface of the interior inverted frustum-shaped wall, a surface of the interior bowl, and a surface of the female apex form a mortar internal profile;
- the mortar internal wall surface comprises elements chosen from the group consisting of flutes and ribs;
- the mortar bowl surface comprises elements chosen from the group consisting of flutes and ribs;
- the mortar internal profile and the pestle external profile are substantially similar;
- when the pestle rests within the mortar with the male apex nesting within the female apex, the pestle external profile aligns with the mortar internal profile; and
- a locus of an axis of the pestle describes a cone when the pestle is rotated through a circular locus, the cone angle being about 40 degrees.

2. An apparatus, comprising:
- a pestle, the pestle comprising:
  - a dome-shaped top portion, the top portion formed to be cupped within the palm of a hand of a user;
  - a body portion extending from the top portion; and
  - a bottom portion extending from the body portion and opposing the top portion, the bottom portion formed to include a male apex, wherein a surface of the body portion, a surface of the bottom portion, and a surface of the male apex form a pestle external profile; and
- a mortar, the mortar comprising:
  - a base;
  - a wall extending from the base, the wall topped with a lip; and
  - an interior, the interior comprising:
    - an interior inverted frustum-shaped wall adjacent to the lip; and
    - an interior bowl extending from the interior inverted frustum-shaped wall, the bowl formed to include a female apex, the female apex formed to cooperate with the male apex; and wherein:
- a surface of the interior inverted frustum-shaped wall, a surface of the interior bowl, and a surface of the female apex form a mortar internal profile; and
- the mortar internal profile and the pestle external profile are substantially similar.

3. The apparatus of claim 2, wherein when the pestle rests within the mortar with the male apex nesting within the female apex, the pestle external profile aligns with the mortar internal profile.

4. The apparatus of claim 2, wherein the body portion is cylindrical.

5. The apparatus of claim 4, wherein a locus of an axis of the pestle describes a cone when the pestle is rotated through a circular locus.

6. The apparatus of claim 5, wherein the cone forms an angle of between 20 and 60 degrees.

7. The apparatus of claim 2, wherein the body portion is in the shape of an inverted frustum of a cone.

8. The apparatus of claim 2, wherein:
- the bottom portion is in the shape of an inverted top of a cone; and
- the bowl is in the shape of an inverted top of a cone.

9. The apparatus of claim 2, wherein:
- the bottom portion is dome-shaped; and
- the bowl is dome-shaped.

10. The apparatus of claim 2, wherein the dome-shaped top portion forms a portion of an oblate spheroid.

11. The apparatus of claim 2, wherein:

the bottom portion forms a portion of a prolate spheroid; and the bowl forms a portion of a prolate spheroid.

12. The apparatus of claim 2, wherein:

the bottom portion forms a portion of a rotated vesica piscis; and the bowl forms a portion of a rotated vesica piscis.

13. The apparatus of claim 2, wherein the pestle body surface comprises elements chosen from the group consisting of flutes and ribs.

14. The apparatus of claim 2, wherein the pestle bottom surface comprises elements chosen from the group consisting of flutes and ribs.

15. The apparatus of claim 2, wherein the mortar internal wall surface comprises elements chosen from the group consisting of flutes and ribs.

16. The apparatus of claim 2, wherein the mortar bowl surface comprises elements chosen from the group consisting of flutes and ribs.

17. A method, comprising:

(a) placing a material to be processed into a mortar, the mortar comprising:

a base;

a wall extending from the base, the wall topped with a lip;

an interior, the interior comprising:

an interior inverted frustum-shaped wall adjacent to the lip;

an interior bowl extending from the interior inverted frustum-shaped wall, the bowl formed to include a female apex, wherein a surface of the interior inverted frustum-shaped wall, a surface of the interior bowl, and a surface of the female apex form a mortar profile;

(b) placing a pestle within the mortar, the pestle comprising:

a dome-shaped top portion, the top portion formed to be cupped within the palm of a hand of a user;

a body portion extending from the top portion; and a bottom portion extending from the body portion and opposing the top portion, the bottom portion formed to include a male apex, wherein a surface of the body portion, a surface of the bottom portion, and a surface of the male apex form a pestle profile;

(c) nesting the male apex within the female apex;

(d) aligning the pestle profile with the mortar profile; and (e) rotating the pestle top portion in a circular locus while pivoting the male apex within the female apex.

18. The method of claim 17, wherein the alignment of the pestle profile with the mortar profile sweeps around in a circular locus.

19. A method, comprising:

(a) placing a material to be processed into a mortar, the mortar comprising a female apex;

(b) placing a pestle within the mortar, the pestle comprising a male apex;

(c) nesting the male apex within the female apex, wherein a profile of the pestle aligns with a profile of the mortar;

(d) rotating the pestle in a circular locus, wherein:

the nesting of the male apex within the female apex remains substantially stationary; and the circular locus of the axis of the pestle forms a cone.

* * * * *